US005548079A

United States Patent [19]

Nakano

[11] Patent Number: 5,548,079

[45] Date of Patent: Aug. 20, 1996

[54] MUSIC SEQUENCER WITH SKIP OPERATION TO RECORDED POSITIONS ASSOCIATED WITH TONE PARAMETER SETS

[75] Inventor: Yoshinobu Nakano, Saitama, Japan

[73] Assignee: Kabushiki Kaisha Kawai Gakki Seisakusho, Shizuoka-Ken, Japan

[21] Appl. No.: 376,648

[22] Filed: Jan. 20, 1995

Related U.S. Application Data

[63] Continuation of Ser. No. 87,292, Jul. 8, 1993, abandoned.

[30] Foreign Application Priority Data

Oct. 14, 1992 [JP] Japan ..... 4-301733

[51] Int. Cl.[6] ..... G10H 1/06; G10H 1/46; G10H 7/00

[52] U.S. Cl. ..... 84/609; 84/622; 84/633

[58] Field of Search ..... 84/609–614, 634–638, 84/641, 642, 470 R, DIG. 29, 622–625, 633

[56] References Cited

U.S. PATENT DOCUMENTS 3,955,466 5/1976 Goldmark ..... 84/470 R 4,924,745 5/1990 Kimpara et al. ..... 84/609

5,164,529 11/1992 Saito ..... 84/612

5,233,521 8/1993 Kimpara ..... 84/609

*Primary Examiner*—Stanley J. Witkowski

[57] ABSTRACT

A sequencer for an electronic musical instrument and a method for controlling sequencing of the electronic musical instrument, wherein when a registration switch is depressed after a fast-forward or rewind switch is depressed, a controller controls a disk driver to perform a fast-forward or rewind operation to a position where the registration switch was depressed in a previous recording or playback operation, whereupon the fast-forward or rewind operation is automatically stopped. The controller then reads out stored tone control information which corresponds with the registration switch and outputs a tone in accordance with the tone control information. The sequencer and method of the present application permit the fast-forward or rewind switch to be activated and then released and does not require continual depression of these switches by an operator.

20 Claims, 6 Drawing Sheets

MUSIC SEQUENCER WITH SKIP OPERATION TO RECORDED POSITIONS ASSOCIATED WITH TONE PARAMETER SETS

This application is a continuation of application Ser. No. 08/087,292 filed on Jul. 8, 1993, now abandoned.

BACKGROUND OF THE INVENTION

1. Field of the Invention

The present invention relates to a sequencer used in an electronic musical instrument such as an electronic organ, an electronic piano, a synthesizer, an electronic keyboard, or similar device.

2. Description of the Related Art

Conventionally, a sequencer for recording/playing performance information of an electronic musical instrument on/from a recording medium is integrally or separately provided to an electronic musical instrument such as an electronic organ.

The sequencer has a record (RECORD) function, a play (PLAY) function, a fast-forward (F.F.) function, a rewind (REW.) function, a stop (STOP) function, and a repeat (REPEAT) function, and other similar functions, and is provided with a plurality of operation buttons for controlling these functions.

The sequencer is provided with a plurality of panel switches for setting tone control information for controlling the tone color, tone volume, effects, other characters to be generated, simultaneously storing various kinds of tone control information set upon operation of these panel switches in association with one-touch buttons called registration memory switches, and simultaneously and instantaneously reproducing the setting state of the panel switches upon operation of the registration memory switches as needed.

In the above-mentioned conventional sequencer, when the fast-forward or rewind operation of a music piece to be played is performed, a fast-forward or rewind button for instructing such an operation must remain depressed. When the fast-forward or rewind operation of a long music piece is to be performed, an operator must continue to depress the button for a long period of time until a required position is found, resulting in very poor operability.

A full-scale sequencer has a skip function for skipping performance information to instantaneously access a required position. However, such a sequencer requires additional functions and hardware such as a display function for realizing a real-time display of a performance portion, and displaying a position to be skipped, various operation switches for instructing a position to be skipped, and execution of the skip function. As a result, the arrangement of the sequencer is complicated, and the sequencer becomes very expensive.

SUMMARY OF THE INVENTION

It is, therefore, an object of the present invention to provide a sequencer for an electronic musical instrument, which can improve operability in a fast-forward or rewind operation of performance information without complicating the arrangement of the sequencer.

According to the present invention, there is provided a sequencer for an electronic musical instrument, which includes performance data recording means for recording performance data, panel operation members for setting various kinds of tone control information for controlling tones generated on the basis of the performance data, a plurality of storage instruction members each assigned to a set of the tone control information generated by using the panel operation members, control information memory means for storing sets of tone control information each assigned to one of storage instruction member, and a feed instruction operation member for instructing a fast-forward or rewind operation of the performance data recorded in the performance data recording means, comprising: operation information recording means for, when the storage operation of a set of tone control information is instructed upon operation of one of the storage instruction members, storing operation information of the operated storage instruction member to define a relative relationship with the performance information recorded or played at that instant of the operation of the storage instruction member; and position control means for, when one of the storage instruction members is operated in a state wherein the fast-forward or rewind operation of the performance data is instructed upon operation of the feed instruction member, executing the fast-forward or rewind operation of the performance data to a recording position indicated by the operation information of the operated storage instruction member.

The sequencer further comprises tone control information setting means for, when the position control means controls the fast-forward or rewind operation of the performance data, reading out a set of tone control information stored in the control information memory means in association with the storage instruction member operated at that time, and setting the readout tone control information to a tone generator.

According to the present invention with the above-mentioned arrangement, when the storage instruction member is operated in a state wherein the fast-forward or rewind operation of performance information is instructed upon operation of a feed instruction operation member, the position control means performs the fast-forward or rewind operation of performance information to a position, where the storage operation of tone control information is instructed by the operated storage instruction member, on the basis of information stored in the operation information recording means.

Therefore, a user need only operate the feed instruction member and the storage instruction member to continue the fast-forward or rewind operation of performance information without having to continually operate the feed instruction operation member. The instruction timing of the storage operation of tone control information by the storage instruction member as the stop position of the fast-forward or rewind operation corresponds to a division portion where the user wants to change a music plot. Since the user normally repetitively plays back performance information with reference to this division portion to listen to his or her performance or to practice a keyboard performance, to stop the fast-forward or rewind operation at this division portion matches with a user's preference upon execution of the fast-forward or rewind operation.

When the sequencer further comprises the tone control information setting means, if a user instructs a play operation after the fast-forward or rewind operation, tones controlled by tone control information, which is set in advance in correspondence with a required performance data portion, can be immediately obtained.

DETAILED DESCRIPTION OF THE PREFERRED EMBODIMENT

Figure 1:
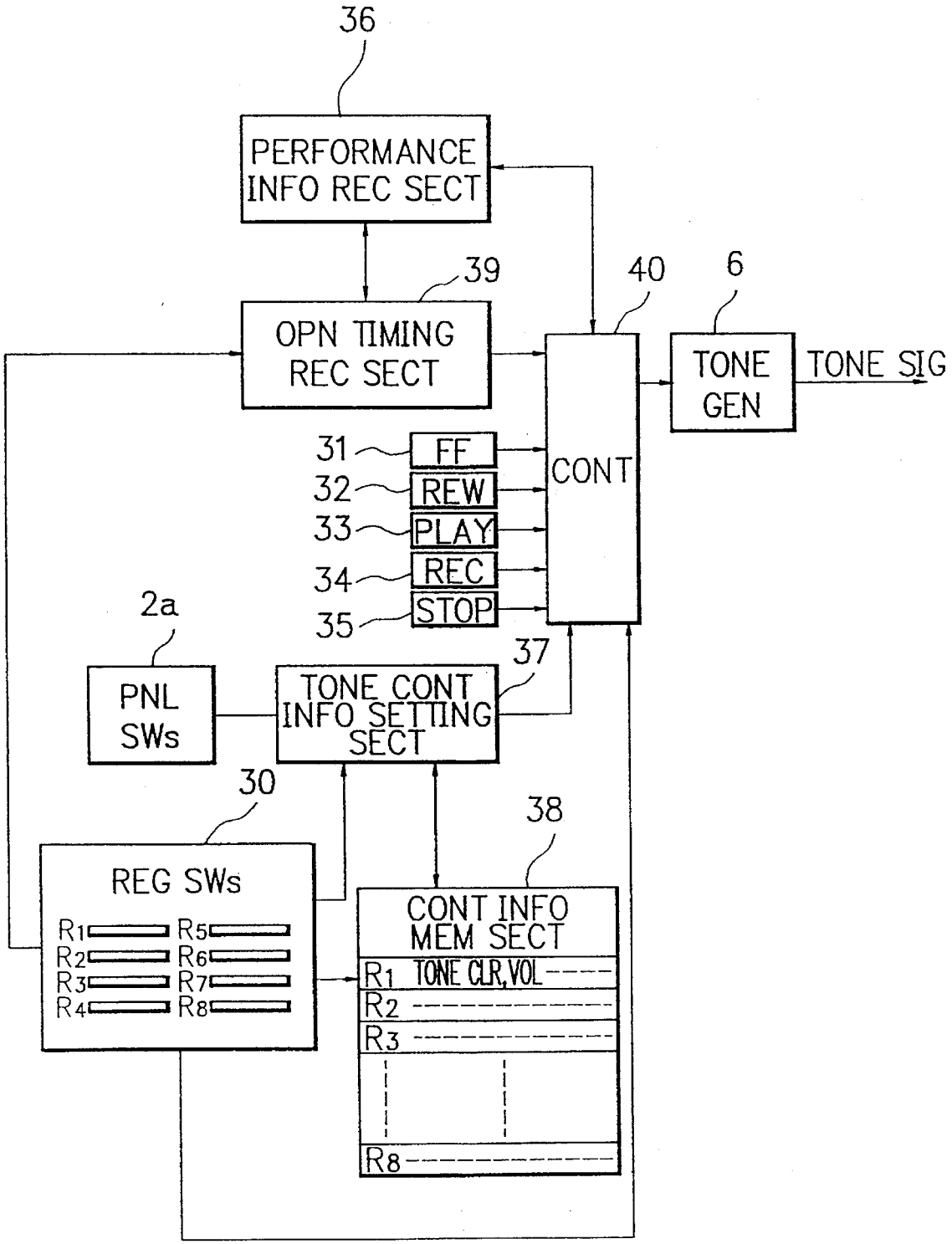
FIG. 1 is a functional block diagram showing a basic arrangement of the present invention.
Figure 2:
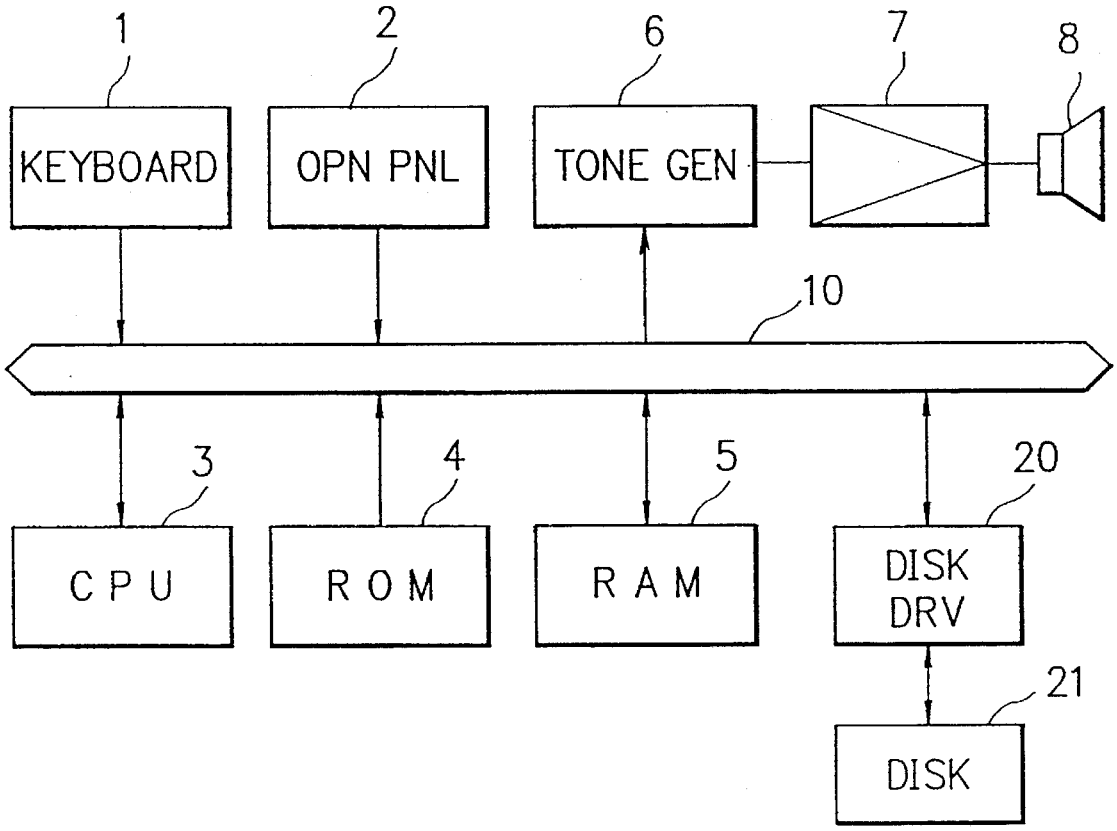
FIG. 2 is a block diagram showing an arrangement of an electronic organ, to which the present invention is applied.

FIG. 1 is a block diagram showing a basic arrangement of the present invention, and FIG. 2 is a block diagram showing the overall arrangement of an electronic organ comprising a sequencer according to an embodiment of the present invention.

In FIG. 2, a keyboard 1, an operation panel 2, a CPU 3, a program & data ROM 4, a RAM 5, and a tone generator 6 are connected to a bus 10. A disk 21 as a recording medium such as a floppy disk is connected to the bus 10 via a disk driver 20.

When a player operates one of keys on the keyboard 1, the CPU 3 detects a key number, key depression/release timing, key depression velocity, and similar characteristics on the basis of a key scan program written in the ROM 4, and supplies corresponding tone data to the tone generator 6. The tone generator 6 reads out sound source data from a waveform ROM (not shown) on the basis of the supplied tone data, and tone control parameter information such as a tone color, tone volume, effects, tempo, and other characteristics, which are set upon operation of various panel switches 2*a* provided to the operation panel 2. The tone generator 6 then processes, an envelope, duration, and other characteristics of a waveform of the readout data, converts the processed data into an analog tone signal, and outputs the tone signal to an amplifier 7. The output from the amplifier 7 is supplied to and reproduced by a loudspeaker 8.

Figure 4:
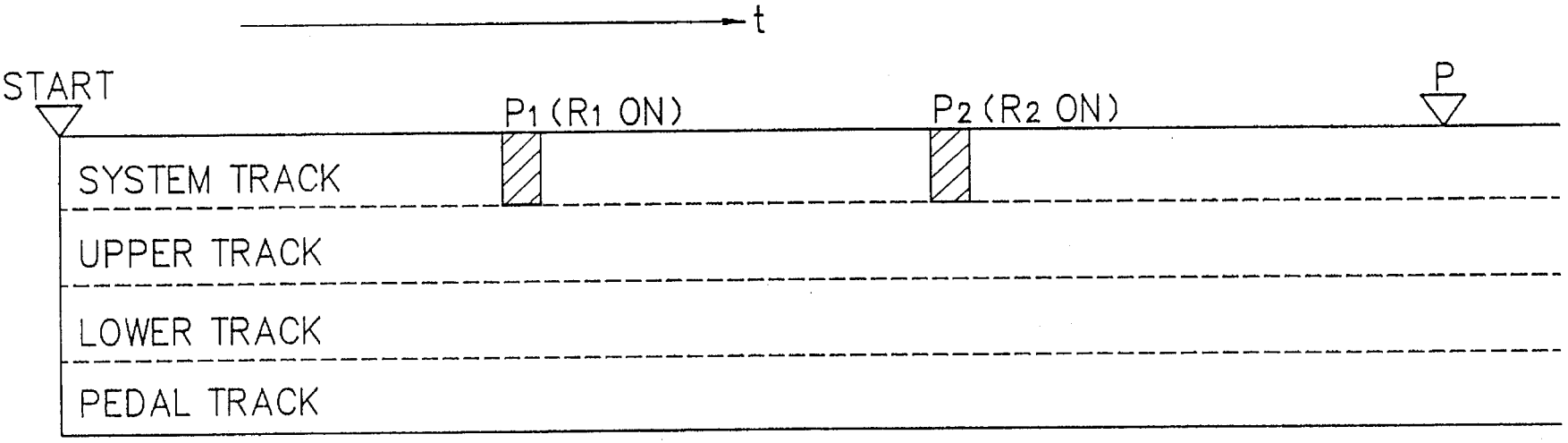
FIG. 4 is a schematic view showing an arrangement of a disk recording section.

When a recording mode is selected upon operation of a REC switch 34, the CPU 3 records tone data obtained by a key operation in the disk 21 via the disk driver 20. As shown in FIG. 4, a recording section of the disk 21 includes of four recording tracks. A system track records system information, and UPPER, LOWER, and PEDAL tracks respectively record performance information by an upper keyboard, lower keyboard, and pedal. When a play mode is selected upon operation of a PLAY switch 33, the CPU 3 transfers performance (tone) data recorded in the disk 21 to the RAM 5, and plays the performance data by the same processing as in the above-mentioned key operation, thus producing playback tones from the loudspeaker 8.

Figure 5:
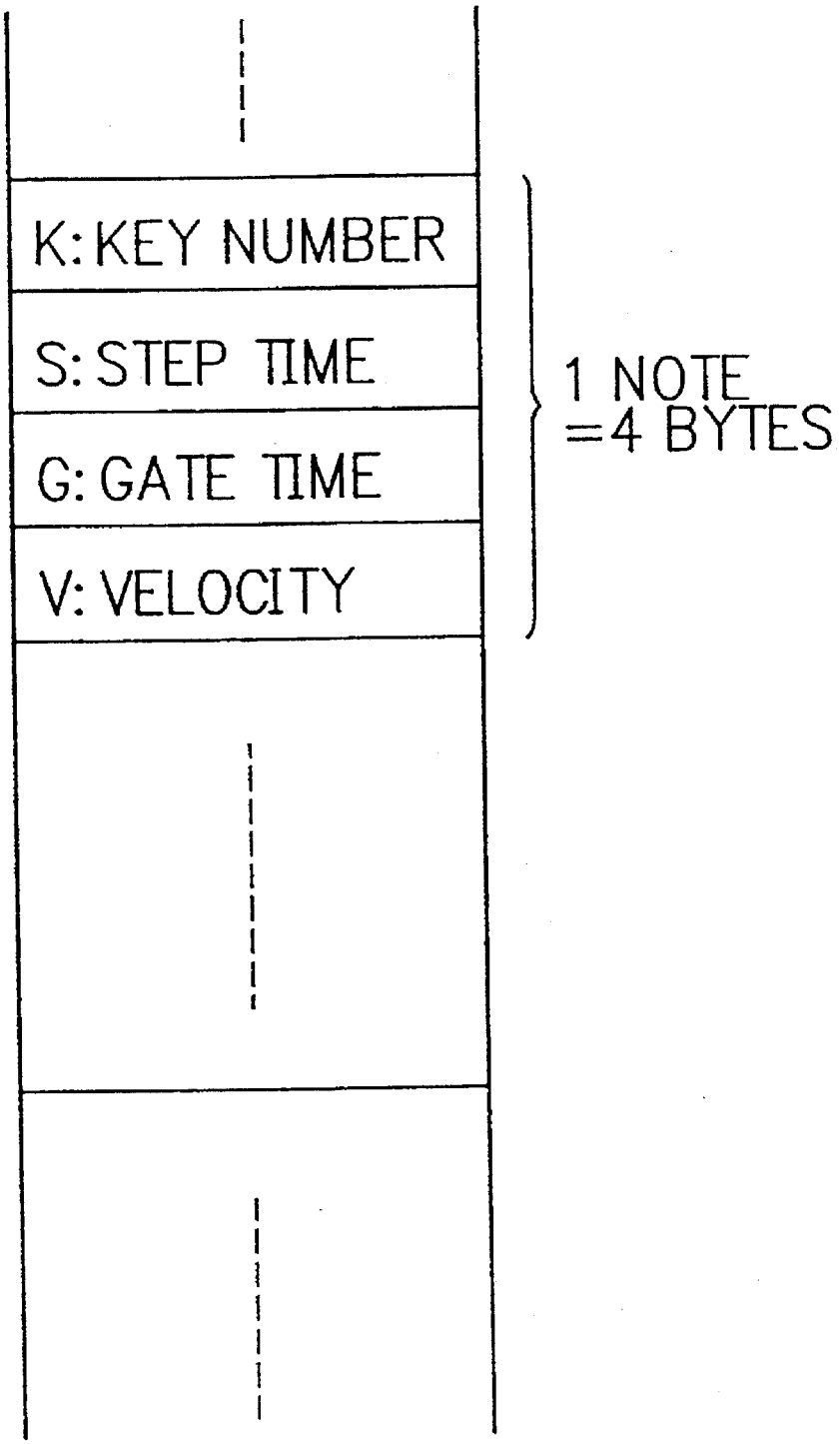
FIG. 5 is a view showing a format of tone data.

FIG. 5 shows the data format of the above-mentioned tone (performance) data. As shown in FIG. 5, the tone data is a note data string in which each note data includes 4 bytes. Each note data includes key number data K representing a serial number of an operated key, step time data S indicating a tone generation timing, gate time data G indicating a tone generation duration, and velocity data V representing a key depression speed.

As shown in FIG. 1, the operation panel 2 is provided with registration memory switches (to be referred to as "REG switches" hereinafter) 30 including eight switches $R_1$ to $R_8$, an FF switch 31 for instructing a fast-forward mode of performance information, an REW switch 32 for instructing a rewind mode of performance information, a PLAY (playback) switch 33 for instructing a playback mode of performance information, an REC (recording) switch 34 for instructing a recording mode of performance information on the disk 21 constituting a performance information recording section 36, a STOP switch 35 for canceling the FF, REW, PLAY, or REC mode and stopping the corresponding operation, a REPEAT switch (not shown) for instructing a repeat mode of the playback operation of a preset portion of performance information, and other tone parameters.

The REG switches 30 include operation members for instructing a storage operation of parameter data such as a tone color, tone volume, and other tone parameters set in a tone control information setting section 37 upon operation of the panel switches 2*a* in a setting information memory section 38. When the switches $R_1$ to $R_8$ are selectively depressed, tone control parameter data set in the tone control information setting section 37 at that time are written in a memory area of the setting information memory section 38 corresponding to the depressed switch.

When one of the REG switches 30 (the switches $R_1$ to $R_8$) is depressed during a recording or playback operation of performance information, an operation timing recording section 39 writes ON information of the operated switch in the system track of the disk 21 constituting the performance information recording section 36, as shown in FIG. 4. More specifically, in an example shown in FIG. 4, information indicating that the switch $R_1$ of the REG switches 30 is depressed at time $P_1$, and the switch $R_2$ of the REG switches 30 is depressed at time $P_2$ is recorded in the system track.

A controller 40 controls the recording operation of performance information in the performance information recording section 36, the playback, fast-forward, and rewind operations of performance information recorded in the performance information recording section 36, the stop operation of the above-mentioned operations, and other similar operations. When one of the switches $R_1$ to $R_8$ of the REG switches 30 is depressed after the FF or REW switch 31 or 32 is depressed, the controller 40 controls the disk driver 20 to perform a fast-forward or rewind operation of performance information to a position where the switch of interest was depressed in the previous recording or playback operation of performance information, and to automatically stop the fast-forward or rewind operation. Then, the controller 40 reads out tone control information stored in the setting information memory section 38 in correspondence with the currently operated switch of the REG switches 30, sets the readout information in the tone control information setting section 37, and causes the sequencer to stand by. Note that the same operation can be performed when the FF or REW switch 31 or 32 and one of the REG switches 30 are simultaneously depressed.

In the example shown in FIG. 4, when the REW switch 32 and the REG switch $R_2$ are simultaneously depressed when performance information recorded in the UPPER, LOWER, and PEDAL tracks is played back to a point P, the rewind operation is automatically performed to a point $P_2$ even when the REW switch 32 is not kept depressed. Furthermore, when the REW switch 32 and the REG switch $R_1$ are simultaneously depressed, the rewind operation is automatically performed to a point $P_1$. Similarly, when the FF switch 31 and the REG switch $R_2$ are simultaneously depressed after the playback operation is started, the fast-forward operation is automatically performed to a point $P_2$ even when the FF switch 31 is not kept depressed. When the PLAY switch 33 is depressed after the fast-forward or rewind operation, the playback operation of performance information is started from the position where the fast-forward or rewind operation was stopped. In this case, the tone colors, tone volumes, and the like of tones generated on the basis of performance information are controlled on the basis of tone control information set in the tone control information setting section 37, as described above.

More specifically, in the above example shown in FIG. 4, when the playback operation of performance information is started from the point $P_1$ after the fast-forward or rewind operation using a REG switch is performed, tones are controlled on the basis of tone control information stored in the setting information memory section 38 in correspondence with the REG switch $R_1$. When the playback operation of performance information is started from the point $P_2$ after the fast-forward or rewind operation is performed to the point $P_2$, tones are controlled on the basis of tone control information stored in the setting information memory section 38 in correspondence with the REG switch $R_2$.

The above-mentioned tone control information setting section 37, the setting information memory section 38, the operation timing recording section 39, and the controller 40 are constituted by a microcomputer system including the CPU 3, the ROM 4, and the RAM 5, and the performance information recording section 36 is constituted by the disk driver 20 and the disk 21.

Figure 6:
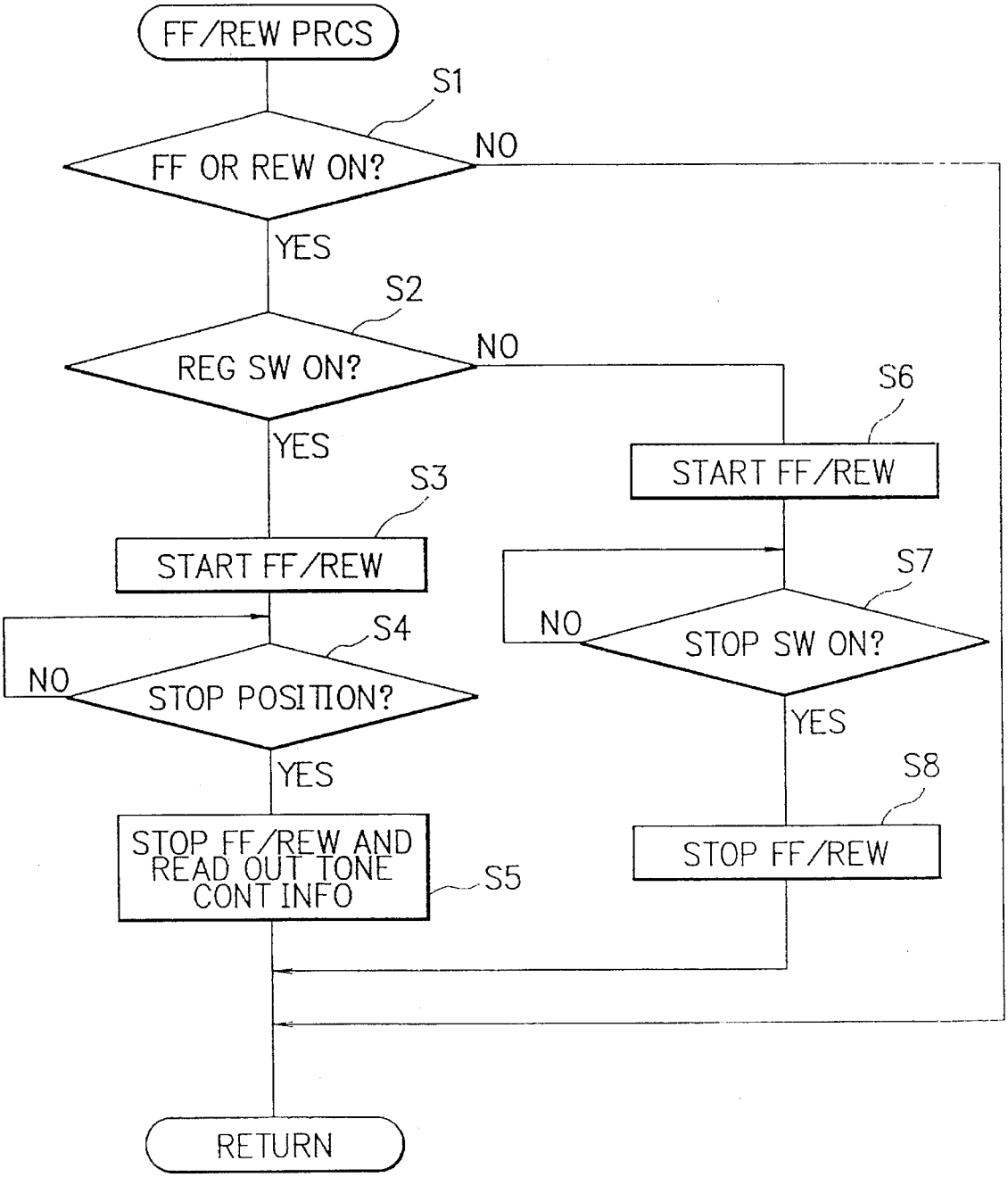
FIG. 6 is a flow chart showing a processing sequence of fast-forward•rewind processing executed by a CPU.

FIG. 6 is a flow chart showing a processing sequence of fast-forward•rewind processing executed by the CPU 3.

In this processing, it is checked in step S1 if the FF or REW switch 31 or 32 is depressed. If YES in step S1, it is checked in step S2 if one of the REG switches 30 is depressed. If it is determined that both the FF or REW switch 31 or 32 and the REG switch 30 are depressed, the flow advances to step S3 to start the fast-forward or rewind operation of performance information in correspondence with whether the operated switch is the FF or REW switch 31 or 32. In step S4, it is checked if the performance information is fast-forwarded or rewound to the stop position of the fast-forward or rewind operation. Note that the stop position of the fast-forward or rewind operation corresponds to a performance information portion which was recorded or played when the storage operation of tone control information in the setting information memory section 38 was instructed previously using a REG switch 30, which is currently operated together with the FF or REW switch 31 or 32.

If it is determined that the performance information has reached the stop position, the fast-forward or rewind operation is stopped in step S5. Also, in step S5, tone control information stored in the setting information memory section 38 in association with the currently operated REG switch 30 is read out and is set in the tone control information setting section 37, and thereafter, a stand-by state is set.

If it is determined in step S2 that the FF or REW switch 31 or 32 alone is depressed, the flow advances to step S6 to start the fast-forward or rewind operation of performance information. The control waits for an ON operation of the STOP switch 35 to stop the fast-forward or rewind operation.

An actual performance operation using the above-mentioned functions will be described below with reference to FIG. 3.

Figure 3:
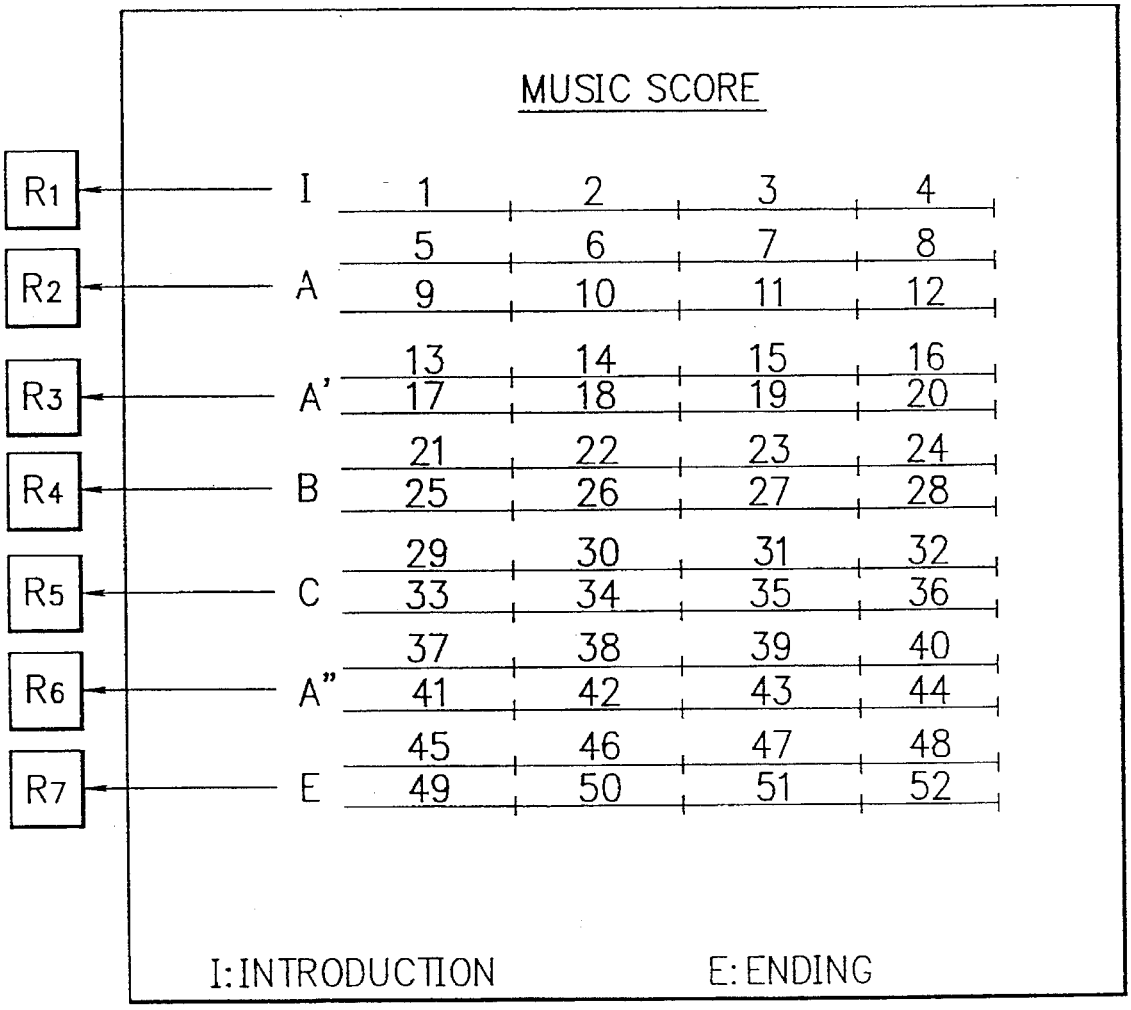
FIG. 3 is a view for explaining the relationship between the construction of a music piece and REG switches.

When a music piece such as the one shown in FIG. 3, is to be played a player of an electronic organ normally forms registrations of tone control information in units of major parts of the music piece, e.g., an introduction part, an A part, . . . , an ending part, and stores these registrations in the memory section 38 in correspondence with the switches $R_1$ to $R_8$ of the REG switches 30. In a performance (playback) mode, the player normally plays back performance information recorded in the performance information recording section 36 while sequentially reading out stored tone control information by sequentially operating these switches $R_1$ to $R_8$. Therefore, it is natural for a player to define a position in a music piece by "from the C part" rather than "from the 33rd bar", and such major parts match with the music score.

When a player tries to practice or play the major part C using the fast-forward and rewind functions of the conventional sequencer, he or she must keep depressing the FF or REW switch to set to the C part. However, according to the sequencer of the above embodiment, when the player depresses the FF switch 31 and then depresses the REG switch $R_5$, the fast-forward operation is performed to the beginning of the C part (33rd bar) even when he or she does not keep depressing the FF switch 31, and the sequencer stands by at the beginning of the C part (33rd bar) in a state wherein tone control information corresponding to the REG switch $R_5$ is read out from the memory section 38. When the player depresses the PLAY switch 33 in this state, the playback operation is started. When the player wants to forward performance information a little more, he or she depresses the FF switch 31 to forward the performance information in units of bars like the 34th bar, 35th bar, . . . .

When the player wants to rewind the performance information to the A part, he or she depresses the REW switch 32, and then depresses the REG switch $R_2$. Thus, the rewind operation is automatically performed to the beginning of the A part (ninth bar) even if he or she does not keep depressing the REW switch 32, and the sequencer stands by at the beginning of the A part (ninth bar) in a state wherein tone control information corresponding to the REG switch $R_2$ is read out from the memory section 38. When the player wants to rewind the performance information a little more, he or she depresses the REW switch 32 to rewind the information in units of bars like the eighth bar, the seventh bar, . . . , and when the rewind operation is stopped, the sequencer stands by in a state wherein tone control information corresponding to the REG switch $R_1$ is read out.

When the REG switches 30 are not used in the corresponding music piece, the above-mentioned fast-forward or rewind operation using the REG switches 30 is not performed.

As described above, according to the above-mentioned embodiment, the fast-forward or rewind operation of performance information can be performed to a required position within a short period of time by a simple operation by utilizing the REG switches provided to a conventional sequencer without adding new operation members and a display function. When the skip function utilizing the REG switches 30 is provided, since the fast-forward or rewind operation coinciding with a music plot and a player's preference can be performed, this results in very good operability. Furthermore, music scores or a collection of music scores with a software disk may be put on a market in future. In such a case, the skip function in the fast-forward or rewind operation may be an indispensable function for a user. According to this embodiment, this function can be added by only modifying a program without complicating the arrangement of the sequencer.

The above-mentioned performance information recording section 36 may comprise other recording media such as a magnetic tape, a RAM, or the like, and the operation timing recording section 39 need not always directly record the operation timing of a REG switch 30 in the disk 21 as long as it can record the operation timing of the REG switch 30.

The feed instruction operation member of the present invention may include the PLAY switch 33. In this case, after the automatic fast-forward or rewind operation of performance data is performed to a predetermined portion, the playback operation is automatically started.

As described above, according to the sequencer for an electronic musical instrument of the present invention, when the fast-forward or rewind operation of performance operation is to be performed, it can be automatically done to a position intended by a user without having to keep operating a fast-forward or rewind instruction operation member and without adding a special display function or operation member for designating a fast-forward or rewind destination. For this reason, operability of the fast-forward or rewind operation can be improved without complicating the arrangement of the sequencer and increasing manufacturing cost.

What is claimed is:

1. A sequencer for an electronic musical instrument, including performance data recording means for recording performance data, panel operation members for setting tone control information for controlling tones generated on the basis of the performance data, a plurality of storage instruction members, each assigned to a set of the tone control information generated by using said panel operation members, control information memory means for storing each set of tone control information assigned to each one of said plurality of storage instruction members, and a feed instruction member for instructing a fast-forward or rewind operation of the performance data recorded in said performance data recording means, said sequencer comprising:

operation information recording means for storing operation information for an operated one of the plurality of storage instruction members to define a relative relationship with the performance data recorded or played concurrently; and position control means for executing the fast-forward or rewind operation on the performance data to a recording position indicated by the operation information of the operated one of the plurality of storage instruction members.

2. The sequencer of claim 1, wherein said position control means stops said performance data recording means at the recording position of the operation information of the operated one of the plurality storage instruction members.

3. The sequence of claim 1, wherein a recording medium of said performance data recording means includes a track for recording the performance data, and a track for recording the operation information by said operation information recording means.

4. The sequencer of claim 1, wherein the operation information includes a serial number of the operated one of the plurality of storage instruction members.

5. The sequencer of claim 1, further comprising tone control information setting means for, when said position control means controls the fast-forward or rewind operation of the performance data, reading out a set of tone control information stored in said control information memory means in association with the operated one of the plurality of storage instruction members operated concurrently, and outputting the readout tone control information to a tone generator.

6. A sequencer for an electric musical instrument, comprising:

mode means for selecting one of a fast-forward mode and a rewind mode of a recorder, including a recording media for recording performance data of said electronic musical instrument;

registration means, including registration switch means to be operated at a predetermined location on said recording media and a registration memory for storing parameter data for tone generation of the performance data; and control means for controlling said recorder in the one of the fast-forward mode and the rewind mode until the predetermined location on said recording media has been reached and reading out said parameter data from said registration memory;

said registration means further including means for recording location data representing of said predetermined location on said recording media, in response to an operation of said registration switch means, and said control means including means for executing one of the fast-forward mode and the rewind mode in response to said registration switch means after the one of the fast-forward mode and the rewind mode is selected by said mode means.

7. The sequencer of claim 6, said registration means further including means for assigning the parameter data, including means for assigning tone parameters including a tone color and a tone volume, and means for assigning the predetermined location on a system track of said recording media.

8. The sequencer of claim 6, wherein the parameter data is selected after the one of the fast-forward mode and the rewind mode is selected.

9. The sequencer of claim 6, wherein the parameter data is selected at the same time as the one of the fast-forward mode and the rewind mode is selected.

10. The sequencer of claim 6, wherein said control means executes a fast-forward operation or a rewind operation until the predetermined location has been reached.

11. The sequencer of clam 6, wherein activation of said registration means after activation of said mode means permits said mode means to be activated and released.

12. The sequencer of claim 6, wherein activation of said registration means concurrent with activation of said mode means permits said mode means to be activated and released.

13. The sequencer of claim 6, further comprising tone generating means for generating a musical tone in accordance with the performance data corresponding to the parameter data.

14. A method for controlling sequencing of an electric musical instrument, comprising the steps of:

(a) selecting one of a fast-forward mode and a rewind mode of a recorder, the recorder including a recording media for recording performance data of the electronic musical instrument;

(b) operating a registration switch at a predetermined location on the recording media and a storing parameter data for tone generation of the performance data in a registration memory;

(c) controlling the recorder in the one of the fast-forward mode and the rewind mode until the predetermined location on the recording media has been reached and reading out the parameter data from the registration memory;

(d) recording location data representing of the predetermined location on the recording media, in response to an operation of the registration switch; and (e) executing one of the fast-forward mode and the rewind mode in response to the registration switch after the one of the fast-forward mode and the rewind mode is selected.

15. The method of claim 14, wherein said step (b) includes the sub-steps of:

(b) (1) selecting the parameter data including tone color and tone volume, (b) (2) selecting the predetermined location on a system track of the recording media, and (b)(3) setting the tone parameters and the predetermined location.

16. The method of claim 14, wherein the parameter data is selected concurrently with the one of the fast-forward mode and the rewind mode.

17. The method of claim 14, wherein the parameter data is selected after the one of the fast-forward mode and the rewind mode.

18. The method of claim 16, wherein the one of the fast-forward mode and the rewind mode is activated and released.

19. The method of claim 17, wherein the one of the fast-forward mode and the rewind mode is activated and released.

20. The method of claim 14, further comprising the step of:

(d) generating a musical tone in accordance with the performance data.

* * * * *